US006016919A

United States Patent [19]

Smith et al.

[11] Patent Number: 6,016,919

[45] Date of Patent: Jan. 25, 2000

[54] PACKAGING CONTAINER FOR ALLOWING INSPECTION OF CONTENTS

[75] Inventors: Jeffrey A. Smith, Clark; Richard N. Beneroff, Chatham; Eric Kim, Secaucus, all of N.J.

[73] Assignee: Motion Design, Inc., Linden, N.J.

[21] Appl. No.: 08/993,951

[22] Filed: Dec. 18, 1997

[51] Int. Cl.[7] ..... B65D 5/50; B65D 85/42

[52] U.S. Cl. ..... 206/774; 206/418; 206/525; 206/583; 206/770

[58] Field of Search ..... 206/418, 466, 206/497, 525, 583, 731, 735, 774, 777, 778, 779, 780, 757, 769, 770, 775, 784, 45.33, 45.34, 738, 739, 807

[56] References Cited

U.S. PATENT DOCUMENTS

| | | | |
|---|---|---|---|
| Re. 30,098 | 9/1979 | Titchenal et al. . | |
| 457,390 | 8/1891 | Weeks | 206/739 |
| 1,730,437 | 10/1929 | Sanderson | 206/735 |
| 1,985,075 | 12/1934 | Bird | 206/418 X |
| 2,032,386 | 3/1936 | Wood | 206/807 X |
| 2,114,422 | 4/1938 | Guyer | 206/807 X |
| 2,956,672 | 10/1960 | Kirkpatrick | 206/497 |
| 3,322,263 | 5/1967 | Gulliver | 206/497 |
| 3,456,780 | 7/1969 | Forman . | |
| 3,544,007 | 12/1970 | Bordman | 206/779 X |
| 3,600,872 | 8/1971 | Sharpnack, Jr. . | |
| 3,627,116 | 12/1971 | Cooper . | |
| 3,669,337 | 6/1972 | Struble . | |
| 3,750,872 | 8/1973 | Bobb . | |
| 3,752,301 | 8/1973 | Bluemel . | |
| 3,796,307 | 3/1974 | McKinney . | |
| 3,853,220 | 12/1974 | Luray . | |
| 3,946,870 | 3/1976 | Gujer et al. | 206/497 X |
| 4,030,603 | 6/1977 | Angell . | |
| 4,087,003 | 5/1978 | Adamek . | |
| 4,180,165 | 12/1979 | Kuchenbecker | 206/779 X |
| 4,285,432 | 8/1981 | de Villers et al. . | |

(List continued on next page.)

FOREIGN PATENT DOCUMENTS

| | | | |
|---|---|---|---|
| 638038 | 3/1962 | Canada . | |
| 670168 | 9/1963 | Canada . | |
| 0969457 | 6/1958 | Germany | 206/418 |
| 0022483 | 9/1930 | Netherlands | 206/418 |
| 0360646 | 4/1962 | Switzerland | 206/418 |
| 904628 | 8/1962 | United Kingdom | 206/45.34 |
| 1425746 | 2/1976 | United Kingdom . | |
| 1426331 | 2/1976 | United Kingdom . | |
| 2239854 | 7/1991 | United Kingdom . | |

*Primary Examiner*—Bryon P. Gehman
*Attorney, Agent, or Firm*—Kenyon & Kenyon

[57] ABSTRACT

A packaging container is provided which allows an enclosed product to be viewed, inspected, and handled without the risk of damage, soiling, or theft. In an exemplary embodiment the container comprises an outer portion and an inner portion, wherein the product may be contained within the inner portion and the inner portion may be at least partially removed from the outer portion. As a specific example, the container may comprise a rigid outer box and a transparent flexible inner bag attached to the outer box. The inner bag, in conjunction with the box, forms an enclosure for the product, and allows the product to be at least partially removed from the rigid box while still being fully enclosed by the packaging container. The container may be closed or sealed at one end and partially blocked at the other end through the use of displaceable barriers. The purchaser may displace the barriers and remove the object from the confines of the outer portion of the container while the object is still contained and confined by the inner portion of the container. Thus the product may be inspected but may not be removed from the package or dirtied or damaged, nor may another product be inserted into the package without evidence of tampering existing.

9 Claims, 7 Drawing Sheets

U.S. PATENT DOCUMENTS 4,306,653 12/1981 Fales .
4,328,896 5/1982 Behne .
4,606,459 8/1986 Luray ..... 206/583
4,757,900 7/1988 Misset et al. .
4,852,743 8/1989 Ridgeway .
4,923,065 5/1990 Ridgeway .
5,044,495 9/1991 Wyshotshy ..... 206/497 X
5,056,665 10/1991 Boecker et al. .
5,071,009 12/1991 Ridgeway .
5,086,925 2/1992 Coalier et al. .
5,108,803 4/1992 Kondo et al. .
5,129,518 7/1992 Tanaka et al. .
5,218,510 6/1993 Bradford .
5,226,531 7/1993 Garwood .
5,226,542 7/1993 Boecker et al. .
5,240,111 8/1993 Yamashita et al. .
5,251,760 10/1993 Smith et al. .
5,259,507 11/1993 Smith .
5,287,968 2/1994 Ridgeway .
5,323,896 6/1994 Jones .
5,388,701 2/1995 Ridgeway .
5,579,917 12/1996 Lofgren et al. .

PACKAGING CONTAINER FOR ALLOWING INSPECTION OF CONTENTS

BACKGROUND OF THE INVENTION

The present invention relates to a packaging container for enclosing products and articles which allows the enclosed articles to be viewed by a purchaser or seller, but prevents the theft of or damage, marring, soiling or contamination to the product. The invention can hold, for instance, a light bulb, stemware, art pieces, cosmetics or other objects.

Present packaging, for instance light bulb packaging, allows purchasers to open the container to view the product, but also allows purchasers to remove a product from a container. This allows a person to remove the product from the packaging container and subsequently to put the product into a packaging container with a different, less expensive price tag, enabling that person to defraud the seller. Furthermore, allowing the product to be removed from the packaging container means the product may be damaged, marred, or dirtied by direct handling.

SUMMARY OF THE INVENTION

It is therefore desirable to have a container that allows purchasers and sellers to view the product and to partially remove the product from an outer portion of the container for inspection, but that does not allow purchasers to completely remove the product from the container. By actually removing the product from the outer portion of the container, consumers are able to check the product for size, shape, color, smell, marks, strength, quantity or other characteristics, properties, virtues, or qualities beyond the extent possible with current packaging. Other improvements may be achieved through the use of the present invention, such as, for instance, cushioning and protection of the product, contamination resistance, aesthetic enhancement of the displayed product or the display of product, consumer, bar-code or other messages.

The present invention provides for an improved packaging container which allows an enclosed product to be viewed, inspected, and handled without the risk of damage, soiling, or theft. In an exemplary embodiment the container comprises an outer portion and an inner portion, wherein the product may be contained within the inner portion and the inner portion may be at least partially withdrawn from the outer portion. As a specific example, the container may comprise a rigid outer box and a transparent flexible inner bag attached to inside of the outer box. The inner bag, in conjunction with the box, forms an enclosure for the product, and the inner bag allows the product to be partially removed from the rigid box while still being inside the inner bag and thus fully enclosed by the packaging container. In another example the object may be sealed entirely within the bag.

The package may be partially or fully assembled at a manufacturer's facility and shipped flat to the user, who erects the container or completes assembly of the container and inserts the product to be enclosed.

The outer portion of the container may be closed or sealed at the first end and open or partially blocked at the second end, for example through the use of displaceable barriers. The purchaser may displace the barriers and remove the object from the confines of the outer portion of the container while the object is still contained and confined by the inner portion of the container. Thus the product may be inspected but may not be dirtied or damaged; furthermore if the first end is sealed or if the object is sealed within the bag, the product may not be fully removed from the container nor may another product, possibly of greater value, be inserted into the container without evident damage to some part of the container.

BRIEF DESCRIPTION OF THE DRAWINGS

An embodiment of the invention is illustrated by way of example in the accompanying drawings.

DETAILED DESCRIPTION

I. Overview

The present invention seeks to provide an advancement in the art by providing a packaging container which will allow viewing, handling and/or inspection of the contents enclosed in the container, and which will allow the contents to be partially removed from the outer confines of an outer portion of the container, while not allowing the contents to be completely removed from the container. The packaging container furthermore protects the article from damage, marring, and dirt, or other contamination.

Figure 1:
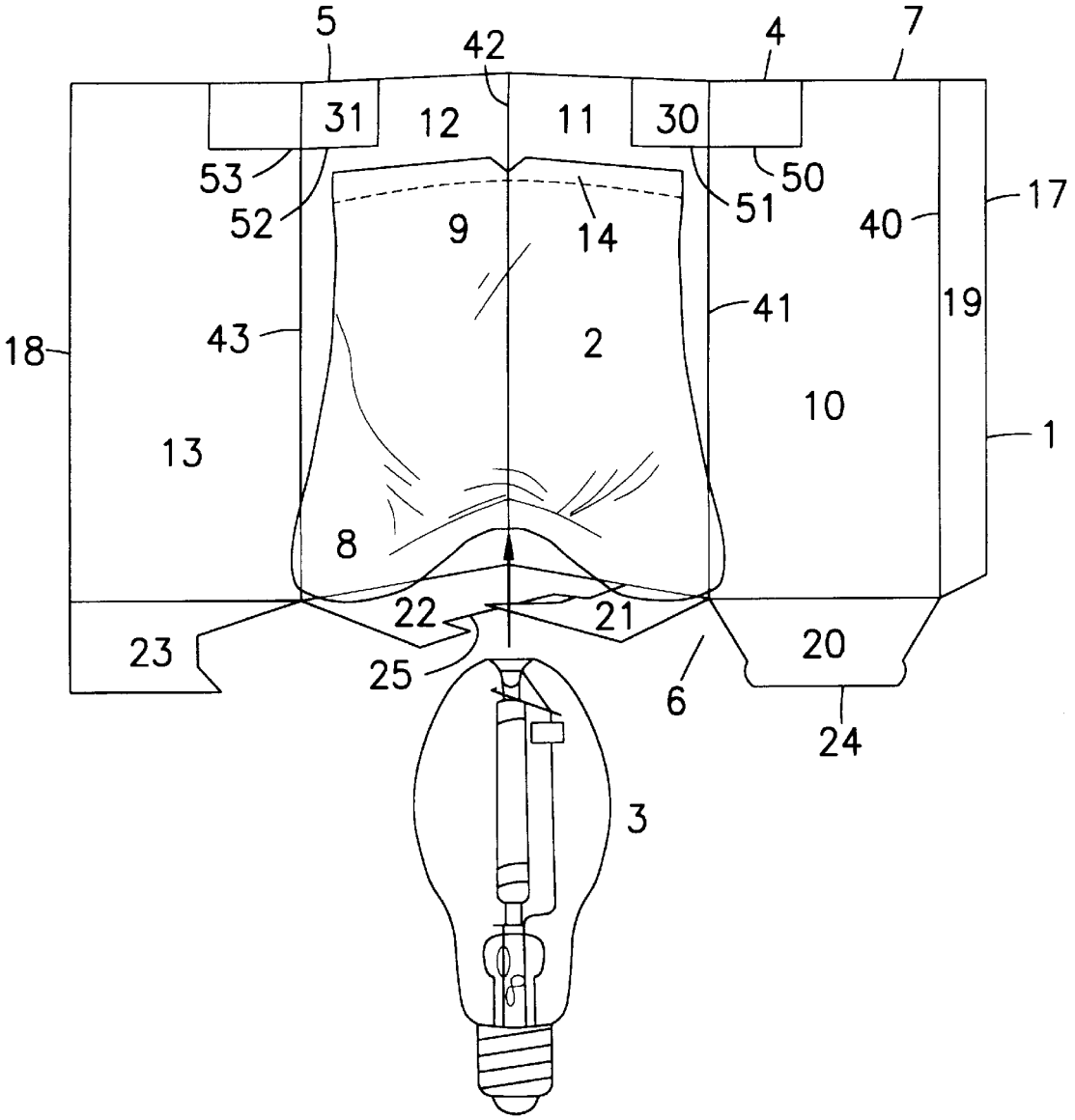
FIG. 1 shows an exemplary embodiment of a packaging container according to the present invention with the side panels shown opened to reveal the various components of the container.

Referring to FIG. 1, one example of the present invention is a package for articles and products consisting of a rigid outer body 16, composed of cardboard, chipboard, or other foldable material, and a flexible and transparent inner bag 2. It should be appreciated that FIG. 1 shows the box split open to display the inside of the box. In actual use, side panel 10 will be connected to side panel 13 via connection flap 19 to form the completed box.

Figure 5:
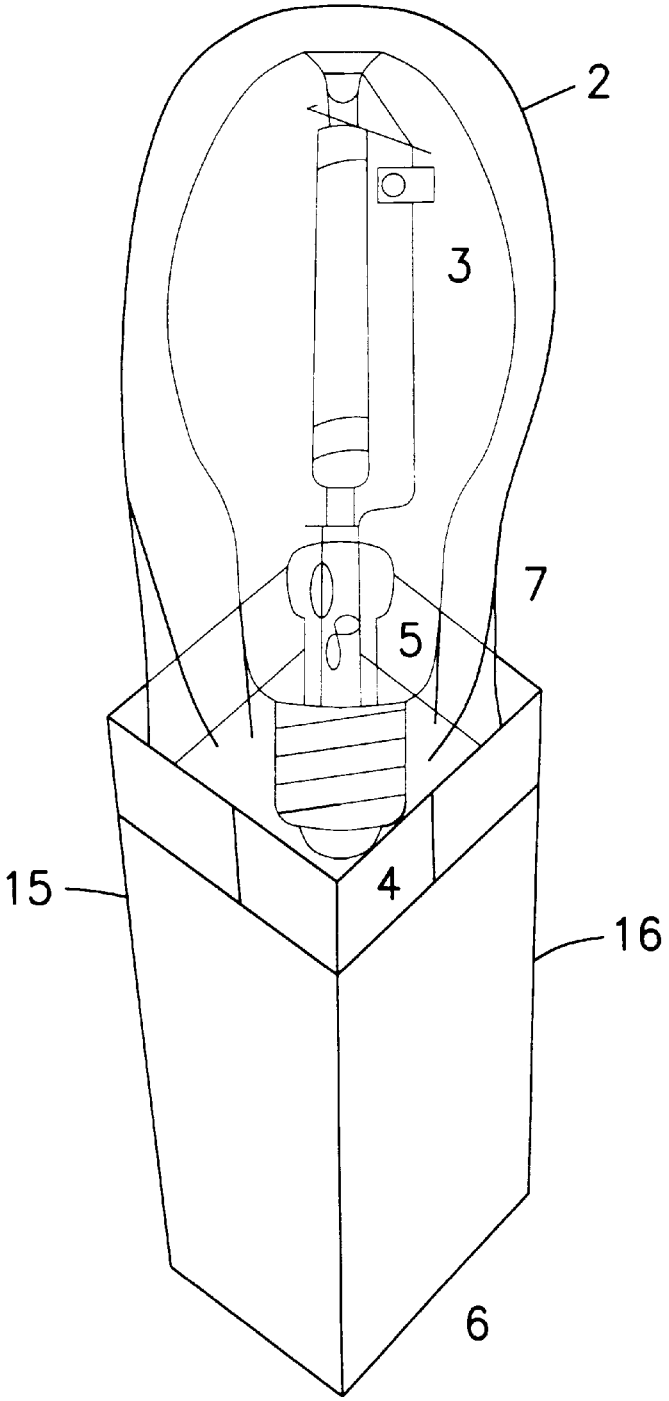
FIG. 5 shows a view of the packaging container of FIG. 1 with the product being removed from the outer portion of the fully assembled container.

The inner bag combines with the outer box to provide a package which surrounds the product or article to be packaged and allows the article to be viewed and partially removed from the outer body 16 of the packaging container, as shown in FIG. 5. Because if the first end of the container is sealed and because the object is retained within the inner bag, part of the container (either the inner bag or outer box) must be forceably opened, torn or broken to allow the article to be completely removed from the container. Thus it is easy to detect whether or not the article has been completely removed from the container.

II. Outer Portion of the Container

In the exemplary embodiment of FIG. 1, the rigid outer body 16 is formed from an integral sheet of rigid material, preferably corrugated cardboard or chipboard. The sheet is folded along fold lines 40–43 to produce in an exemplary embodiment a rectangular parallelepiped box with four elongated rectangular sides 10–13, for example with opposite panels having equal width, and two open ends 6 and 7, the ends in this example being rectangular, one of the open ends being closed by flaps 20–23, described below, and the other open end being selectively blocked by displaceable barriers 4 and 5, described below.

Figure 4:
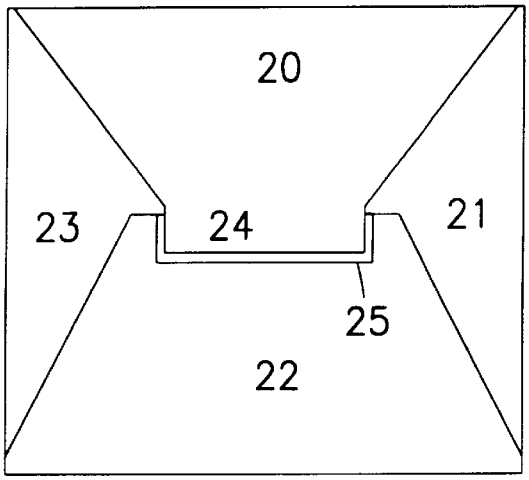
FIG. 4 shows a view of an end of the rigid outer box of FIG. 1 after full assembly.

At the first open end 6, end flaps 20–23 extend out from the rectangular sides 10–13 of the box, with one end flap extending from each of the four sides, the end flaps being foldable in an inward direction to form an end closure. When the end flaps 20–23 are folded inward, they overlap and interconnect as described below, and as shown in FIG. 4. In another embodiment of the present invention the end flaps 20–23 may be sealed, for example with the use of tape or glue, to create a closure which can only be breached in a highly visible manner by tearing or otherwise damaging the end flaps. The first end 6 of the box may be closed or sealed in any number of other manners known in the art, for example using an auto-lock bottom. As described in greater detail below, slits 50–53, which are disposed towards the second end 7 of the box 16, define displaceable barriers which partially close the second end of the packaging container 15.

III. Inner Portion of the Container

In the exemplary embodiment as seen in FIG. 1, the inner portion of the container is in the form of an inner bag 2 comprised of a transparent, flexible material. The inner bag 2 has a closed end 8 and an open end 9. The inner bag may be a plastic or other polymer, or another material, for example a mesh or net. It may take any convenient shape, for example a tube or a gussetted shape. The bag 2 has an inner side and an outer side. Initially, the inner bag is completely enclosed within the rigid box 16, the closed end 8 of the inner bag points in the direction of the first, flapped, end 6 of the rigid box 16, and the open end 9 of the inner bag points towards the second end 7 of the rigid box 16. As shown in the drawings, the inner bag 6 is bonded to the rigid box 16 at a fixed location. In the illustrated embodiment, the outer portion of the inner bag 2 is bonded, near its open end 9, to the inner portion of the rigid outer body 16, near the second end 7 of the rigid outer body 16. Bonding can be achieved by, for example, glue, tape, heat or mechanical fasteners such as staples.

Figure 2:
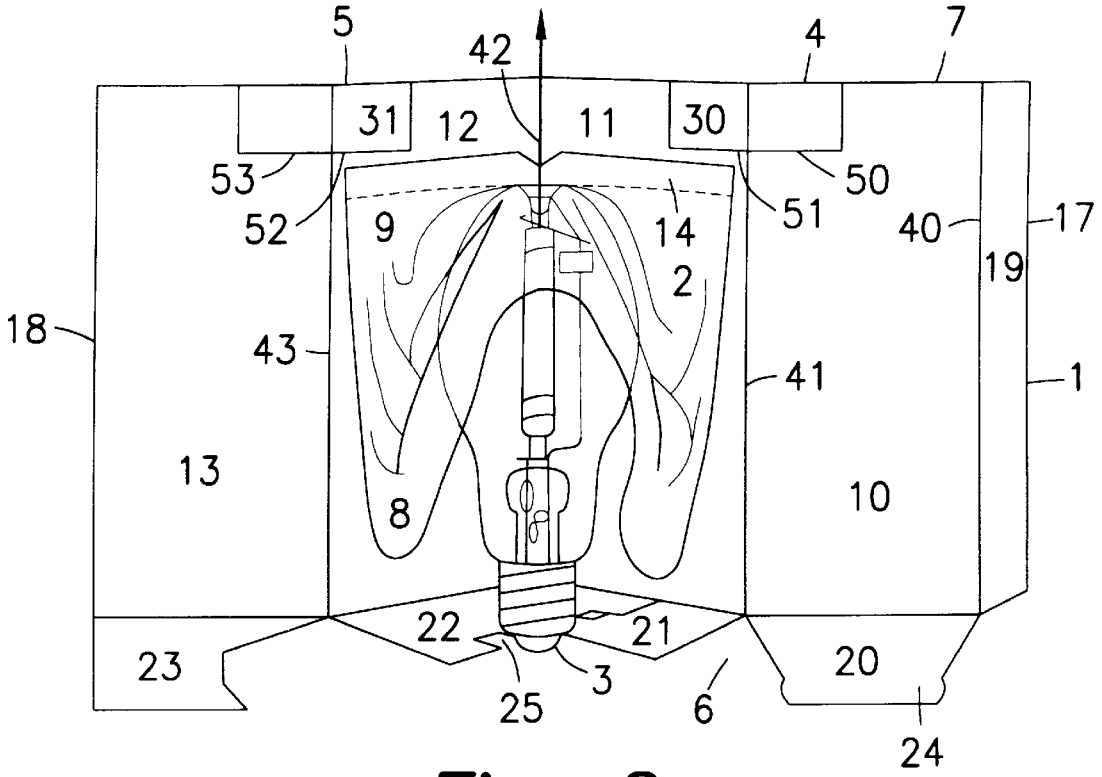
FIG. 2 shows the packaging container of FIG. 1, again with the side panels shown opened to reveal the inside of the container, with the product being inserted into the packaging container.

The product, for example a light bulb 3, is inserted in the first end 6 of the rigid box 16, and is thereby inserted in the packaging container 15. As seen in FIG. 2, as the product 3 is inserted, it displaces the inner bag 2, forcing the closed end 8 of the bag 2 towards the second end 7 of the rigid outer body 16.

Figure 3:
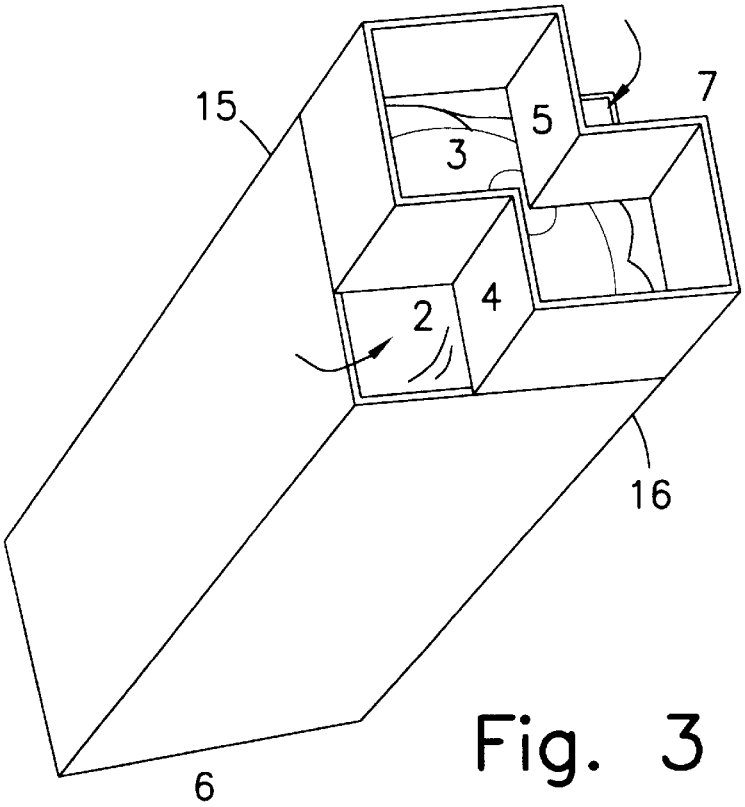
FIG. 3 shows the packaging container of FIG. 1 completely assembled, with displaceable barriers moved so as to prevent the product from being removed from the box.

When fully packaged, the first end 6 of the rigid outer body 16 may be closed by mechanically joining the four end flaps 20–23, which extend from the sides 10–13 of the rigid outer body 16 at the first end 6, as described below, or the first end 6 may sealed by, for example, glueing, taping, or otherwise fastening the end flaps 20–23. The second end 7 of the outer body 16 is partially closed by folding inward the two displaceable barriers 4 and 5 formed by the slits 50–53, as described below. Thus the product 3 is prevented from falling outside the bounds of the rigid outer body 16. As seen in FIG. 3, the product 3 can be viewed through the second end 7 of the packaging container 15, as the flexible bag 2 is transparent, and the displaceable barriers 4 and 5 only partially obscure the product 3.

A tab may be attached to the closed end 8 of the bag to allow easy withdrawal of the inner bag 2 from the outer box 16. In addition to allowing the product to be inspected without its complete removal from the packaging container, other improvements may be achieved through the use of the flexible bag of the present invention. For instance, the bag may provide cushioning and protection of the product or aesthetic enhancement of the displayed product. The bag may be imprinted with customer service, consumer, barcode or other messages, or it may be colored. The bag may be a net or mesh, instead of the transparent material described above. It may be reinforced with a rigid or semi-rigid frame instead of being completely flexible.

Figure 7:
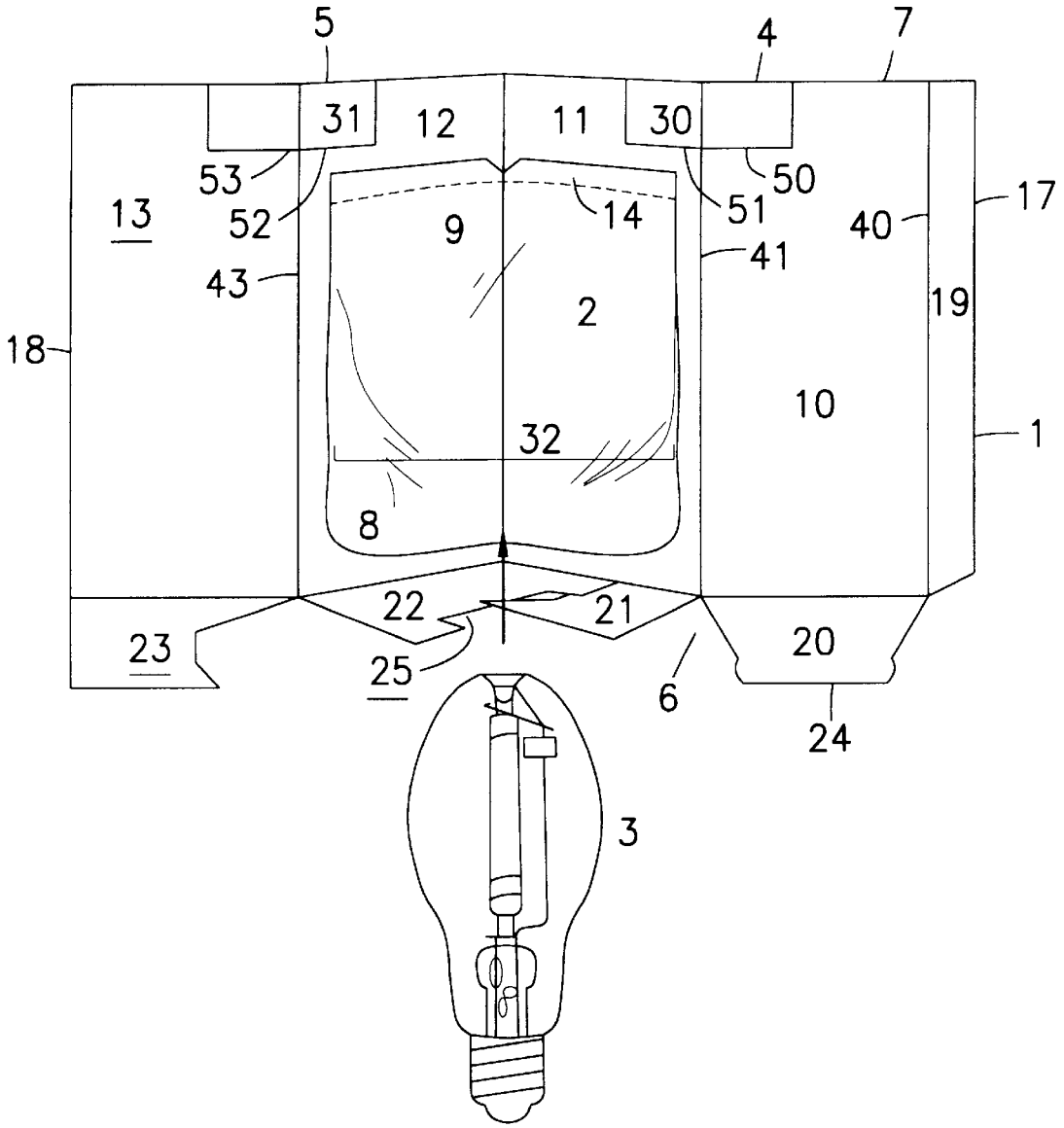
FIG. 7 shows another exemplary embodiment of a packaging container according to the present invention with the side panels shown opened to reveal the various components of the container.

In another exemplary embodiment, illustrated in FIG. 7, bag 2 is provided with a slit 32 located at any available position. Bag 2 is bonded at bond 14 to the inner side of the box 16 at one of sides 10–13, and may be sealed by the manufacturer at its open end 9. The user inserts the object 3 in the bag 2 through slit 32 and may seal slit 32. It should be appreciated that FIG. 7 shows container 15 split open to display its components; in actual use, side panel 10 will be connected to side panel 13 via connection flap 19 to form the completed box. Glue strip 14 exists on one side of bag 2 and joins bag 2 to only one of sides 10–13. In addition, a small amount of glue 33 may be provided near the bottom 8 of bag 2 to hold bag 2 in place as product 3 is inserted into bag 2.

Figure 8:
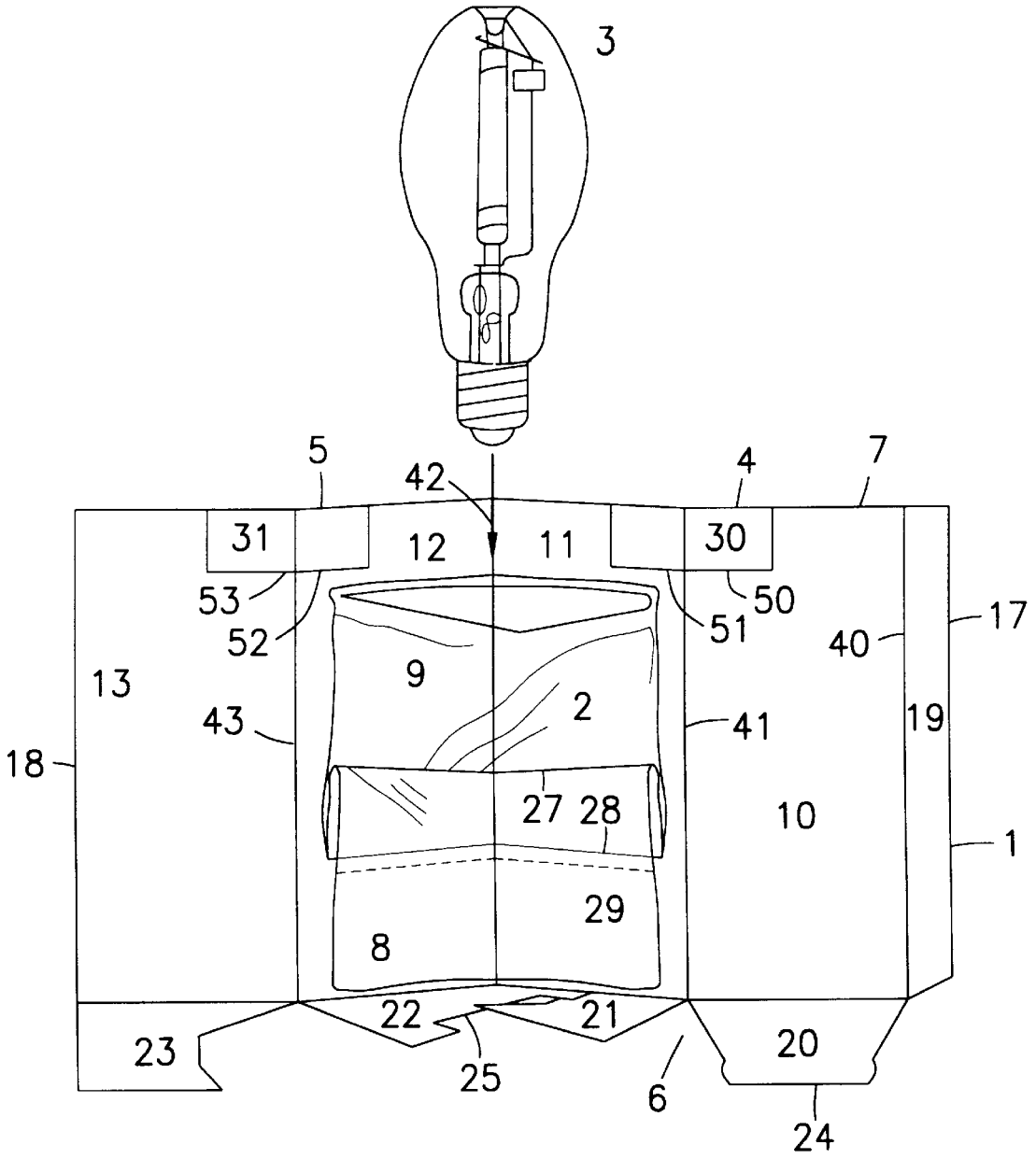
FIG. 8 shows another exemplary embodiment of a packaging container according to the present invention with the side panels shown opened to reveal the various components of the container.
Figure 9A:
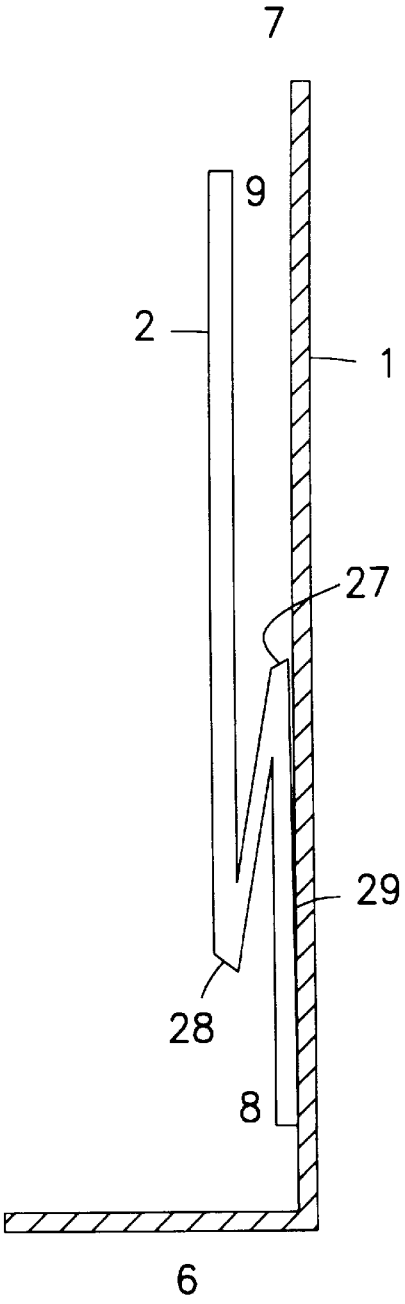
FIG. 9*a* illustrates the attachment of the inner bag to the outer box in the packaging container of FIG. 8.
Figure 9B:
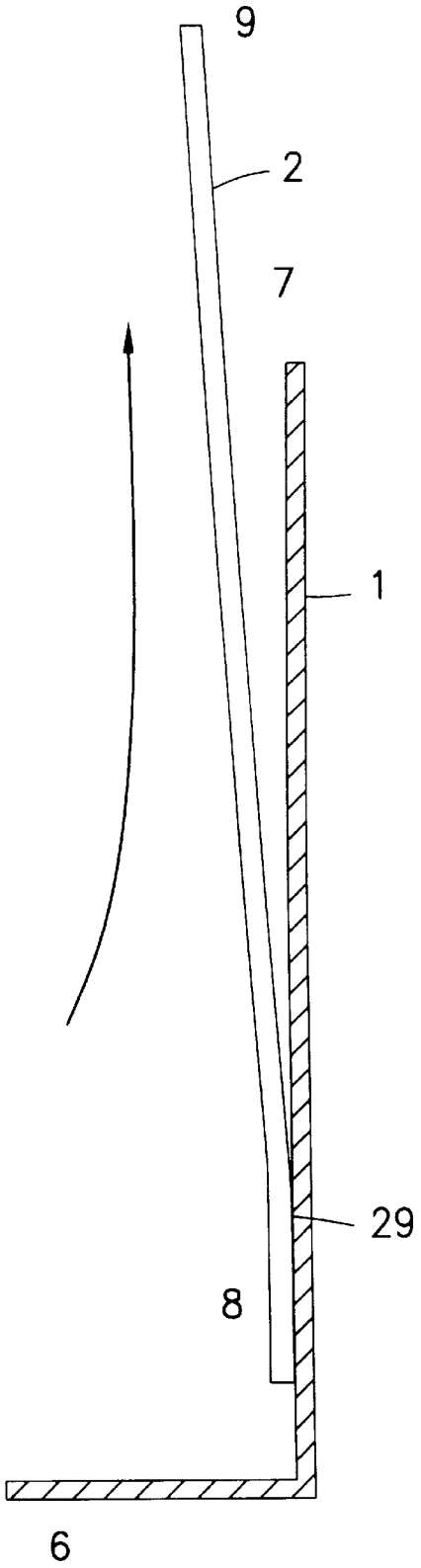
FIG. 9*b* illustrates the removal of the inner bag from the outer box in the packaging container of FIG. 8.

In yet another exemplary embodiment, illustrated in FIG. 8, the user may insert the object 3 in the open end 9 of the bag 2 through the second end 7 of outer box 16, then seal the bag 2 in between the location of the object 3 and the open end 9 of the bag 2. In this exemplary embodiment the inner bag is folded at folds 27 and 28, and glued to outer body 16 at glue strip 29, located at the bottom 8 of bag 2. It should be appreciated that FIG. 8 shows container 15 split open to display its components. Glue strip 29 exists on both sides of bag 2; thus when sides 10 and 13 join they will in addition adhere to bag 2 at glue strip 29. The location of glue strip 29, in conjunction with folds 27 and 28, allows the bag 2 to be extended from its folded position, illustrated in FIG. 9*a*, and pulled partially out of the box 16, as illustrated in FIG. 9*b*. In this manner object 3 is also removed from box 16, yet remains sealed within bag 2. In the exemplary embodiments shown in FIGS. 7 and 8 the object 3 is cushioned by and may be floated by bag 2 and still may be pulled out of the container 15 for inspection while remaining sealed in the bag 2.

IV. Operation

FIG. 5 illustrates the operation of the box of FIG. 4 to allow inspection of the product 3. If a close inspection or handling of the product 3 is desired, the displaceable barriers 4 and 5 can be folded outward so as to be aligned flush with the four sides 10–13 of the box 16. The product 3 can then be moved towards and past the second end of the box 7, and removed from the confines of the rigid box 16, but cannot be completely removed from the container 15 without tearing the flexible bag 2 or opening the flaps 20–23 on first end 6. By actually removing the product from the bounds of the box 16, purchasers are able to check the product for size, shape, color, smell, marks, quantity, strength or other characteristics, properties, virtues or qualities.

The product 3 is enclosed in a space defined by the first, closed or sealed end 6 of the box 16 and by the flexible bag 2, which is bonded at bond 14 to the inner side of the box 16. The bag 2 may only be bonded to the box 16 to the extent needed to contain the product 3 within the packaging container, and to the extent needed to make removal of the product 3 impossible without tearing or breaking the bag 2 or the bond 14, or by opening the box at the first end 6. If, as in certain exemplary embodiments, either the flaps 20–23 at the first end 6 are sealed with, for example, glue, or the object is sealed within the bag, then in order for the product 3 to be completely removed from the container 15, part of the container 15 must be destroyed, such as by tearing or cutting; thus the product 3 cannot be completely removed from the container 15, nor can a different product be inserted into the container, in a manner which will go undetected. Flexible bag 2 further protects the product from damage and dirt.

V. Displaceable Barrier

At the second open end 7 of the illustrated example displaceable barriers 4 and 5 are formed. In this exemplary embodiment these barriers 4 and 5 are formed by creating a slit (slits 50–53 are shown) along each of the four sides 10–13, each slit 50–53 starting near and running parallel to the open edge of each side 10–13, preferably approximately one third to one half the way along the width of each side 10–13, each slit 50–53 extending from one of the two edges of each side 10–13 and each slit 50–53 meeting the slit disposed on one of the adjacent sides. Thus each side 10–13 has a slit extending preferably from one of the two adjacent edges of the side approximately one third to one half way to the midpoint of the width of the side, each slit 50–53 meeting the slit disposed on only one of the adjacent sides.

In this manner two portions of the rigid material 30 and 31 disposed between the slits 50–53 and the open edge at the second opening 7 may be folded radially inward, as seen in FIG. 3, toward the center of the assembled box 16, to create partial barriers 4 and 5 which may be displaced, as illustrated in FIG. 5, by a person desiring to access the product 3 inside the packaging container 15. These two portions 30 and 31 are defined by the four slits 50–53. When the two displaceable barriers 4 and 5 are folded radially inward as seen in FIG. 3, they form two partial barriers which prevent the product 3 from being removed from the confines of the outer box 16. When the two displaceable barriers 4 and 5 are not folded inward, but are aligned with the sides 10–13 from which they are formed, the product 3 can be removed from the outer box 16 at the open end 7 to the extent that the inner bag 2 permits, as described below. The slits 50–53 may extend along more or less than the above mentioned one third to one half of the width of each side 10–13, making the displaceable barriers 4 and 5 larger or smaller. It should be noted that the displaceable barriers 4 and 5 may be formed by another method, and there may be more or less than two displaceable barriers. Other mechanisms may be used to temporarily close, either partially or wholly, the second end of the box.

VI. Closed End

In the illustrated exemplary embodiment of the present invention each end flap 20–23 opposes one of the other end flaps. When the end flaps 20–23 are folded radially inward, they in addition extend slightly inward towards the middle of the assembled box 16. The first opposing pair 20 and 22 of end flaps mate by having a tab 24 located on the shaped outer edge of one of the flaps (the "tabbed flap" 20) fit into a slot or indentation 25 in the other flap comprising the pair (the "receiving flap" 22). Each flap 21 and 23 comprising the second opposing pair of end flaps is inserted into the space created between the tabs comprising the first pair 20 and 22, and each flap in the second pair 21 and 23 provides pressure in an axial outward direction on the tabbed flap 20, which in turn provides axially outward pressure on the receiving flap 22. This exemplary embodiment is illustrated in FIG. 4. The four end flaps 20–23 may also be sealed using, for example, glue or tape. It should be noted that four end flaps are not required, nor is it required that the flaps join as described above; alternative embodiments may use other numbers and configurations of end flaps to close or seal the first end 6 of the box 16.

VII. Formation of Container

The packaging container 15 may be formed from one integral piece of rigid material 1, for example preferably cardboard or chipboard, and one integral piece of transparent flexible material 2, for example plastic. The rigid material 1 is cut, bent, and fastened using known methods to form a rectangular parallelepiped box 16. When the material is cut, two parallel opposing edge portions 17 and 18 are formed, the edges 17 and 18 extending in what will become the lengthwise direction of the box.

In the illustrated exemplary embodiment the rigid material 1 is folded along four parallel folds 40–43, each fold extending in what will become the lengthwise direction of the box, to form four rectangular sides 10–13 and one rectangular connection flap 19, the connection flap being adjacent to one of the sides 10, separated from that side by one of the folds 40. The rigid material 1 is cut so that one of each of the above described four end flaps 20–23 extends lengthwise from a first end of each of the four sides 10–13, and a slit (one of 50–53) is cut near the second end of each of the four sides. These four slits 50–53 will define the two displaceable barriers 4 and 5, described above. The connection flap 19 is glued or otherwise attached to the one side 13 having as one of its axial (lengthwise) edges an outer edge of the integral piece of rigid material 1, so as to connect this side 13 to the side 10 which is adjacent to the flap 19. In this manner box 16 is formed.

Figure 6:
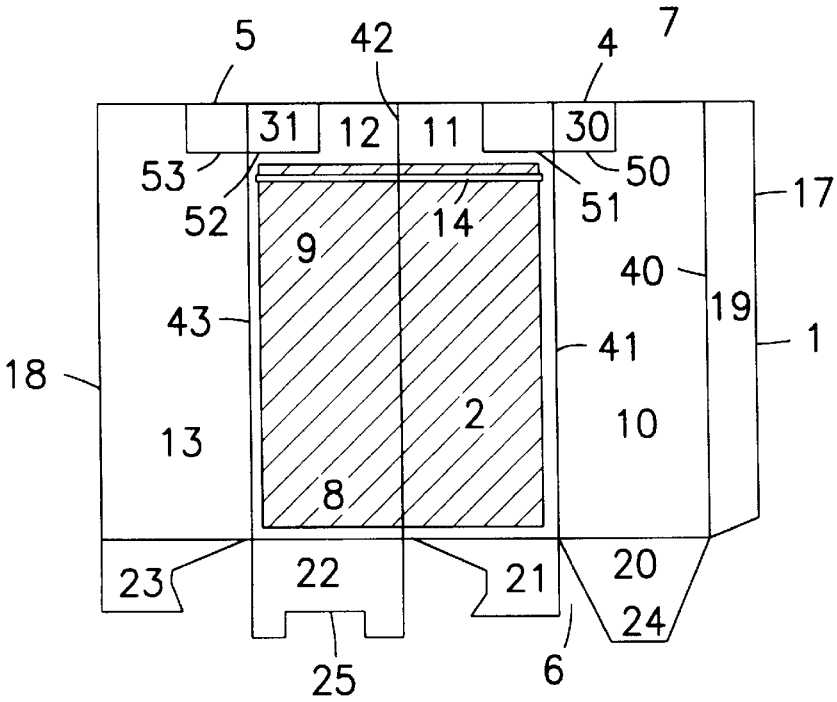
FIG. 6 shows the packaging container of FIG. 1 after a panel is cut to form the box and after a bag is glued to two sides of the panel, but before complete assembly.

As seen in FIG. 6, when the container 15 is being assembled the bag 2 is first bonded to the panel for forming the rigid box 1 on only two sides 11 and 12 of the panel 1. As the panel 1 is folded and completely assembled, sides 10 and 13 come into contact with glue strip 26, which is on the outer surface of the open end 9 of bag 2, bonding bag 2 to box 16 on all four sides 10–13. Thus when the container 15 is fully assembled with side 10 connected to side 13 by flap 19, as in FIG. 3, the bag 2 is bonded to all four sides 10–13 of the fully assembled box 16. Of course, numerous other variations are possible for the connection and/or retention of the inner portion of the container with respect to the outer portion of the container.

In the illustrated exemplary embodiment, the partially formed packaging container may be shipped from the manufacturer to the user completely cut, glued and assembled but flat. The user then expands the folded packaging container, inserts the product to be packaged, and closes or seals the end 6 to create the completed, filled packaging container 15. The user may also move barriers 4 and 5 inward to create a barrier to the product 3 being removed from the container 15.

VIII. Summary

While the invention has been described in connection with one illustrated embodiment, it is not intended to limit the invention to the particular forms set forth above, but, on the contrary, it is intended to cover such alternatives, modifications, and equivalents as may be included within the spirit and scope of the invention as defined by the appended claims.

For example, the materials used to construct the outer portion are not limited to corrugated cardboard or chipboard, but may be any foldable material, and the inner portion may be constructed out of any material such as plastic or other polymer, mesh, or fabric. Other forms of the inner portion of the container are possible which allow at least partial removal of the contents from the outer portion of the container without allowing removal of the contents from the container. The outer portion may be constructed out of one integral piece of material, or may be fabricated from multiple components. It may be of a shape other than rectangular, and may have a number of sides other than four. As discussed above, the closed end may be closed in any way, using any number of flaps; for instance, the closed end may be sealed with glue or staples, or may be closed by having a number of flaps join mechanically. The barrier at the second end of the box may be constructed in a way different from that described above, or may be replaced or eliminated.

While the illustrated exemplary embodiment is shown holding a light bulb, the invention of course can be used to hold countless other objects, including, for example, stemware, art pieces or cosmetics.

In addition to allowing the contents to be inspected without complete removal from the packaging container, other improvements may be achieved through the use of the present invention. For instance, the inner portion may provide cushioning and protection of the product or aesthetic enhancement of the displayed product. It may be imprinted with customer service, consumer, bar-code or other messages, or it may be colored.

What is claimed is:

1. A package comprising:

an outer portion;

an inner portion disposed inside the outer portion; and means bonding the inner portion to the outer portion at a fixed location between the inner portion and the outer portion;

the outer portion of the package comprising:

a first opening in the outer portion;

means for sealing the first opening of the outer portion, wherein an object may be sealed within the package such that once the object is sealed within the package the object may not be removed from the package, nor may another object be inserted into the package, without unsealing the package; and a second opening in the outer portion, wherein the second opening in the outer portion allows access to the inner portion;

wherein when the first opening is sealed the inner portion may be moved from a first position in which the object and the inner portion are within the bounds of the outer portion to a second position in which the object and the inner portion are at least partially withdrawn from the outer portion to allow the object to be inspected, wherein the movement from the first position to the second position is accomplished by moving the object and the inner portion at least partially outside the bounds of the outer portion; and wherein the inner portion may be repeatably moved from the first position to the second position and back to the first position without releasing the bond between the inner portion and the outer portion.

2. The package of claim 1 wherein the outer portion comprises a box.

3. The package of claim 2 wherein the box has at least one displaceable barrier such that, when the at least one displaceable barrier is in a first position, the barrier prevents the object and inner portion from being pulled through the second opening, and, when the at least one displaceable barrier is in a second position, the object and the inner portion may be pulled through the second opening to the extent the inner portion permits.

4. The package of claim 3 wherein the box is manufactured from one integral sheet of material and wherein the at least one displaceable barrier is created from the sheet by the use of slits.

5. The package of claim 2 wherein the box is manufactured from one integral sheet of material.

6. The package of claim 1 wherein the inner portion comprises a bag.

7. The package of claim 1 wherein the inner portion is transparent.

8. The package of claim 7 wherein the inner portion is plastic.

9. The package of claim 1 wherein when the object is placed within the inner portion, the inner portion may be sealed such that the object may not be removed from the inner portion without opening the inner portion.

* * * * *